US005900343A

United States Patent [19]

Ochiai et al.

[11] Patent Number: 5,900,343

[45] Date of Patent: May 4, 1999

[54] FERRITE CARRIER FOR ELECTROPHOTOGRAPHIC DEVELOPMENT

[75] Inventors: Masahisa Ochiai, Fukaya; Masumi Asanae; Tsutomu Saitoh, both of Saitama, all of Japan

[73] Assignee: Hitachi Metals, LTD., Tokyo, Japan

[21] Appl. No.: 08/905,956

[22] Filed: Aug. 5, 1997

Related U.S. Application Data

[63] Continuation-in-part of application No. 08/805,609, Feb. 25, 1997, Pat. No. 5,876,893.

[30] Foreign Application Priority Data

Aug. 6, 1996 [JP] Japan ..... 8-206750

[51] Int. Cl.[6] ..... G03G 9/107

[52] U.S. Cl. ..... 430/106.6; 252/62.61

[58] Field of Search ..... 430/106.6, 108, 430/111; 252/62.61

[56] References Cited

U.S. PATENT DOCUMENTS 5,466,552 11/1995 Sato et al. ..... 430/106.6

FOREIGN PATENT DOCUMENTS 59-111926 6/1984 Japan .
8-1525 1/1996 Japan .
8-12489 2/1996 Japan .

*Primary Examiner*—John Goodrow
*Attorney, Agent, or Firm*—Morgan, Lewis & Bockius LLP

[57] ABSTRACT

An Li—Mn type ferrite carrier for use in electrophotographic development comprising ferrite particles having a chemical composition of 3 to 15% of $Li_2O$, 5 to 35% of MnO and 60 to 90% of $Fe_2O_3$, each in terms of percent by mole. The ferrite particles consisting essentially of crystal grains having an average grain size of 1 to 50 $\mu$m. The surface of the crystal grains is provided with a minute roughness or unevenness during the production of the ferrite carrier. The minute roughness on the grain surface enhances the ability of the ferrite carrier to triboelectrically charge the toner and the bonding strength of the resin coating to the carrier surface.

11 Claims, 1 Drawing Sheet

FERRITE CARRIER FOR ELECTROPHOTOGRAPHIC DEVELOPMENT

CROSS-REFERENCE TO RELATED APPLICATION

This application is a continuation-in-part of U.S. Ser. No. 08/805,609 filed Feb. 25, 1997, now U.S. Pat. No. 5,876,893.

BACKGROUND OF THE INVENTION

The present invention relates to an Li-Mn type ferrite carrier for use in a two-component developer for developing electrostatic latent images formed on a surface of an image-bearing member (photosensitive drum) of image-forming apparatus such as laser beam printers, dry copying machines, etc. More specifically, the present invention relates to an Li-Mn type ferrite carrier having a high efficiency to triboelectrify the toner, enhancing the bonding strength between a resin coating and the surface of the carrier, and having a long useful life.

In a known electrophotographic developing process utilized in printers, facsimile machines, etc., an electrostatic latent image corresponding to original image or information data being reproduced is formed on the surface of a cylindrical photosensitive drum. A developing roll composed of a sleeve and a permanent magnet mounted interiorly in the sleeve is disposed opposite to the photosensitive drum. A magnetic developer is magnetically attracted on the surface of the sleeve and transported to a developing zone by the rotation of the sleeve. The magnetic developer forms a magnetic brush in the developing zone, and the surface of the photosensitive drum is brushed by the magnetic brush to develop the electrostatic latent image to a visual toner image. The toner image is transferred onto a recording sheet which is then heated to permanently fix the toner image thereon.

As the developer, one-component developer containing only a toner or two-component developer which is a mixture of a toner and a magnetic carrier has been used. In the two-component developer development, the toner and the magnetic carrier are mixed together in a predetermined mixing ratio, and acquire triboelectric charges of opposite polarities by friction. During the brushing contact, only the toner charged to a predetermined polarity is deposited on the image areas on the photoconductive surface by electrostatic attraction between the latent image and the toner to produce visual toner images.

Generally, the two-component developer is required to have a good stability to reproduce images with a high quality in continuous developing operation. To attain a good stability, it is necessary to regulate the ability of the magnetic carrier to triboelectrify the toner and the specific volume resistance of the developer within a suitable level. In addition, it is desirable that these properties are not changed even in a long developing operation.

The toner is a fine powder usually produced by blending a binder resin with several additives such as a colorant including dyestuff and pigment, a magnetic powder, a charge control agent, a wax, etc. to disperse the additives through the binder resin, and pulverizing the blended product to a predetermined particle size.

As the material for the carrier, iron powder and a ferrite powder have been mainly used. To make the ability to triboelectrify the toner and the specific volume resistance stable, several considerations have been made. Such considerations include, for example, developing new binder resin, charge control agent, or other additives for the toner, selecting the binder resins, charge control agents, or other additives for the toner, improving the method of oxidation-treating the iron carriers, selecting the material for the ferrite carriers and the surface resin coating, studying the surface property of the carriers, improving the method of resin coating, etc.

The iron carrier is usually produced by subjecting to its surface a suitable treatment such as oxidation treatment. However, in spite of such a surface treatment, the iron carrier physically or chemically changes its surface conditions in a longtime use to produce spent toners (toners fused to carriers). The spent toners reduce the ability of the carrier to triboelectrify the toner. The iron carrier has additional defects that the resolution of the images comes to be reduced because the iron carrier is sensitive to moisture in the environmental atmosphere, and that the lift time is short.

The ferrite carrier has come to be used in place of the iron carrier because it is chemically more stable than the iron carrier, it hardly changes its specific volume resistance during the use and its apparent density is about ⅔ of that of the iron carrier. The ferrite carrier is a sintered product of a complete mixture of an iron (III) oxide and at least one oxide of a metal such as Ni, Zn, Mn, Mg, Cu, Li, Ba, V, Cr, Ca, etc., and the ferrite carrier generally used may be made of Ni—Zn ferrites, Mn—Zn ferrites and Cu—Zn ferrites. However, Zn, Ni, etc. are noxious to human body and the disposal of waste ferrite carrier containing such elements is legislatively regulated. Li—Mn ferrites are not legislatively regulated, and therefore, such an advantage of the Li—Mn ferrite carrier is recently noted in the art. However, since the optimal chemical composition and the optimal developing conditions have not yet been established, it is difficult at present to stably reproduce images with a high quality by the use of a developer containing the Li—Mn carrier in a continuous developing operation.

To increase the property of the carrier to triboelectrically charge the toner and prevent the surface coating from exfoliating from the carrier core, it has been proposed to make the carrier surface rough.

Japanese Patent Publication No. 8-1525 proposes a method of forming a rough surface on ferrite carriers due to the geometric shape of primary particles. In the proposed method, a ferrite powder having a small primary particle size of 0.5 to 7 $\mu$m is formed into spherical granulates by spray-drying, and then the granulates are sintered. Japanese Patent Publication No. 8-1525 teaches that the sintering temperature be selected so that the primary particles on the surface of the granulates retain their geometric shape, i.e., so that the primary particles on the surface of the granulates are not fused to form a continuous phase. To ensure the formation of the surface roughness, the sintering temperature is taught to be 900 to 1100° C.

Japanese Patent Publication No. 8-12489 also teaches a ferrite carrier having a surface roughness due to the fine primary crystalline particles. It is taught therein that the sintering temperature is an important factor to form the rough surface because the primary particles are fused to form a smooth surface at a high sintering temperature. Therefore, Japanese Patent Publication No. 8-12489 teach that the sintering be carried out at a relatively low temperature although the sintering temperature generally employed is 1000 to 1400° C.

However, the ferrite particles are insufficiently sintered by the above methods because the sintering temperature is low to retain the geometric shape of the primary particles, and therefore, the ferrite particles are not sufficiently densified. As a result thereof, the carrier thus obtained has a low magnetic force to result in a frequent carrier adhesion to the photosensitive surface. This causes a problem of a poor image quality due to occurrence of white spots in the reproduced image area. Since the surface roughness due to the geometric shape of the primary particles is large and deep, the carrier is not well-agitated with the toner due to its low flowability, thereby reducing the property of the carrier to triboelectrically charge the toner. Therefore, ample time is required to charge the toner to a sufficient level.

OBJECT AND SUMMARY OF THE INVENTION

Accordingly, an object of the present invention is to provide an Li—Mn type ferrite carrier having a high ability to triboelectrically charge the toner, effectively preventing a surface coating from exfoliating therefrom, and having a prolonged life time.

As a result of the intense research in view of the above objects, the inventors have found that the above object can be attained by forming a minute roughness on the crystal grains of the Li—Mn type ferrite. The present invention has accomplished by this finding.

Thus, in a first aspect of the present invention, there is provided a ferrite carrier for use in electrophotographic development comprising ferrite particles having a chemical composition of 3 to 15% of $Li_2O$, 5 to 35% of MnO and 60 to 90% of $Fe_2O_3$, each in terms of percent by mole, the ferrite particles consisting essentially of crystal grains having an average grain size of 1 to 50 $\mu$m, and the crystal grains having a minute roughness on a surface thereof.

DETAILED DESCRIPTION OF THE INVENTION

Figure 1:
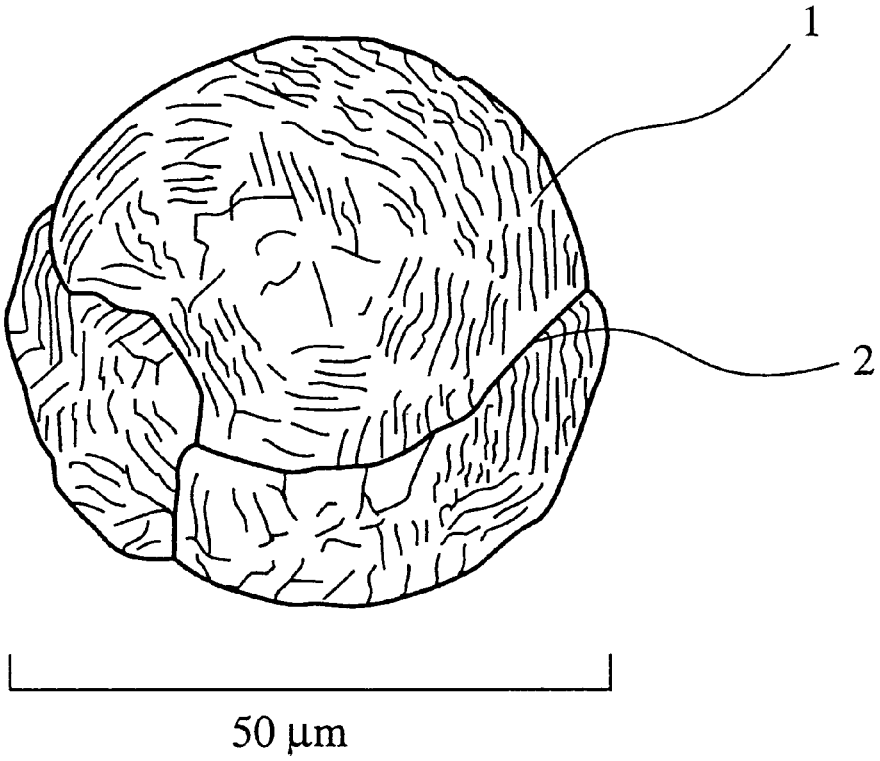
FIG. 1 is an illustrative representation showing the rough surface of the carrier of the present invention, drawn based on a electron photomicrograph.

The ferrite carrier used in the present invention is an Li—Mn type ferrite carrier basically having a chemical composition, by molar percentage, of 3 to 15% of $Li_2O$, 5 to 35% of MnO and 60 to 90% of $Fe_2O_3$. A part of the above essential components may be substituted by at least one bivalent metal oxide selected from the group consisting of NiO, MgO, ZnO, CuO, BaO and SrO in an amount up to 30% by mole based on the total of the ferrite carrier.

An amount of $Li_2O$ less than 3 mol % is disadvantageous because the resultant carrier cannot charge the toner to a sufficient level, the specific volume resistivity becomes so high that the image density is reduced, and the density of solid black image area is uneven due to a high edge effect. When the amount exceeds 15 mol %, the specific volume resistivity is significantly lowered to likely cause the carrier adhesion to the photosensitive surface.

The addition of MnO contributes to increasing the saturation magnetization. When the amount of MnO is less than 5 mol %, the saturation magnetization of the resultant carrier is low to increase the tendency of the carrier adhesion. An amount larger than 35 mol % is not desirable because an excessively high saturation magnetization of the carrier makes the magnetic brush so rigid that the photosensitive surface is scratched or rubbed hard by the rigid magnetic brush to likely cause unfavorable brush marks in the reproduced images.

An amount of $Fe_2O_3$ less than 60 mol % reduces the saturation magnetization of the resultant carrier to result in a low image density and the carrier adhesion. When the amount exceeds 90 mol %, brush marks occur in the image area because the saturation magnetization is too high.

The Li—Mn ferrite carrier of the present invention may contain a sintering aid to increase the density and avoid anomalous growth of crystal grains. The amount of the sintering aid is 0.01 to 1.5 parts by weight, preferably 0.1 to 0.5 parts by weight based on 100 parts by weight of the total of $Li_2O$, MnO, $Fe_2O_3$ and the optional bivalent metal oxide. Such a sintering aid is at least one oxide of elements selected from the group consisting of As, V, Bi, Sb, B, Si and Ca. The oxides may include $As_2O_3$, $V_2O_5$, $Bi_2O_3$, $Sb_2O_3$, $B_2O_3$, $SiO_2$ and CaO. A metal compound which changes to a corresponding oxide during the sintering process, for example $CaCl_2$, $CaCO_3$, etc., may be used as the sintering aid in place of the above oxides.

The average (volume average) particle size of the Li—Mn ferrite carrier, which is calculated from the particle size distribution obtained by a vibration sieve method (JIS H 2601), is preferably 10 to 150 $\mu$m, and more preferably 30 to 100 $\mu$m. The carrier is likely to adhere to the photosensitive surface when the average particle size is less than 10 $\mu$m, and the reproduced images are coarse and unclear when larger than 150 $\mu$m.

The magnetization measured in a magnetic field of 1000 Oe ($\sigma_{1000}$) is preferred to be 45 to 80 emu/g, more preferably 50 to 75 emu/g. When $\sigma_{1000}$ is less than 45 emu/g, the carrier is weakly attracted on a developing roll to likely cause the carrier adhesion, this resulting in white spots in the reproduced image area. When $\sigma_{1000}$ is higher than 80 emu/g, the magnetic brush is so high and rigid that the photosensitive surface is strongly rubbed by the magnetic brush to reproduce images with brush marks or poor in halftone reproduction.

The specific volume resistivity of the Li-Mn ferrite carrier is preferably $10^4$ to $10^{14}$ Ω•cm when measured in an electric field of D.C. 200 V/cm. When the specific volume resistivity is lower than $10^4$ Ω•cm, the carrier is likely to fall off from the magnetic brush to cause the carrier adhesion, and the solid black area varies in the image density due to a strong edge effect when exceeding $10^{14}$ Ω•cm.

The specific volume resistivity may be regulated by changing the content of $Li_2O$ or coating the carrier particles with a resin. Suitable materials for the resin coating may be styrene-acrylic copolymer, silicone resins, fluorine resins, or modified resin such as alkyd modified silicone, epoxy modified silicone, polyester modified silicone, urethane modified silicone, acryl modified silicone, etc. These resin materials may be used alone or in combination of two or more. Of the above materials, silicone resins such as polysiloxane including dimethyl polysiloxane, phenyl methyl polysiloxane, etc. are particularly preferable. The resin coating is preferred to be a thin film covering the entire surface of the carrier particles or partly covering the surface so as to allow the surface of the carrier particles to be partially exposed. The coating amount is preferably 0.1 to 3 parts by weight of the resin material to 100 parts by weight of the carrier particles.

The carrier particles may be coated with the resin material according to the following method. First, the resin material is dissolved, suspended or emulsified in an adequate solvent such as benzene, toluene, xylene, methyl ethyl ketone, tetrahydrofuran, chloroform, hexane, etc., to produce a resin solution, suspension or emulsion. The resin solution, suspension or emulsion is applied on the surfaces of the carrier particles by a fluidized bed coating, a spray coating, a dip coating, etc. To obtain a resin coating uniform in its thickness, the carrier particles are preferably maintained in a fluidized state desirably by employing a spray dryer or a fluidized bed. In the case of the resin solution, the solution is sprayed at about 200° C. or lower, preferably at about 100–150° C., to rapidly remove a solvent from the resultant resin layer. In the case of the resin emulsion, the emulsion is sprayed at a temperature ranging from room temperature to 100° C.

The resin coating may internally and/or externally contain additives which may include an electroconductive material such as carbon black, metals, metal oxides, etc., an inorganic material such as silica, alumina, titanium oxide, talc, etc., and a charge control agent such as nigrosine dye, metal-containing azo dye, triphenylmethane dye, metal complex of alkylsalicylic acid, etc. in an amount accepted in the art.

The Li—Mn ferrite carrier of the present invention may be produced as follows. Predetermined amounts of the oxides ($Li_2O$, MnO and $Fe_2O_3$) are mechanically mixed together with or without the optional bivalent metal oxide and sintering aid. The resultant mixture is calcined at 800 to 1000° C. for 0.5 to 4 hours in an atmosphere such as air, and then, pulverized to fine powder having an average particle size of 0.3 to 3 μm. The fine powder is, after added with a binding agent, if necessary, spray-dried in a heated atmosphere (100 to 200° C.) to be formed into granulates. The granulates thus obtained are then sintered at 1200 to 1300° C. for 2 to 24 hours in an atmosphere such as air. With the progress of the sintering, the primary particles (the fine powder) in the granulates are fused to lose their original geometric shape, and the fused primary particles are combined with each other to grow into crystal grains having an average grain size of 1 to 50 μm, preferably from 10 to 40 μm when calculated from unidirectional maximum diameters of the grains measured on scanning electron photomicrograph.

The sintered product is then heat-treated at 750 to 1200° C., preferably 800 to 1150° C., for 0.5 to 3 hours in an inert gas atmosphere such as nitrogen, etc. containing oxygen in an amount of 5 volume % or less, preferably 2 volume % or less. The heat treatment may be carried out in a rotary kiln, etc. while passing an inert gas into the kiln. With this heat-treatment, a great number of minute roughness or unevenness is formed closely on the surface of the crystal grains. The minute roughness or unevenness on the surface of crystal grains enhances the ability of the carrier to triboelectrically charge the toner. Also, since the bonding strength of the resin coating to the surface of the carrier is improved by the anchor effect of the minute roughness or unevenness, the resin coating is hardly removed from the carrier. In the present invention, the term, "minute roughness or unevenness" means that the height of the projections on the grain surface is 0.5 μm or less when observed by electron photomicrograph.

When the sintering is carried out at a temperature, for example at 1310 to 1400° C., higher than a sintering, temperature usually employed, carrier particles having a relatively small particle size are fused to the surface of carrier particles having a relatively large size. During the fusing of the relatively small particles to the relatively large particles, a great number of minute roughness or unevenness is formed on the surface of the crystal grains. Therefore, the heat treatment, which is employed for providing the sintered product at a usual sintering temperature of 1200 to 1300° C. with the minute surface roughness or unevenness, may be avoided when the sintering is carried out in the temperature range described above.

The toner which constitute a two-component developer together with the ferrite carrier of the present invention is not specifically restricted. The toner concentration in the two-component developer is usually 3 to 10% by weight for the developer containing non-magnetic toner, and 15 to 70% by weight for the developer containing magnetic toner.

The present invention will be further described while referring to the following Examples which should be considered to illustrate various preferred embodiments of the present invention.

EXAMPLES 1–3 AND COMPARATIVE EXAMPLES 1–2

Production of Carrier

A starting powdery material containing $Li_2O$, MnO and $Fe_2O_3$ in respective amounts shown below was mixed in a ball mill. The starting material for each of the carriers A to C was added with a sintering aid ($V_2O_5$) in an amount of 0.2 parts by weight based on 100 parts by weight of the ferrite components. The mixture was calcined at 900° C. for 2 hours, and pulverized by an attritor to a powder having an average particle size about 0.7 μm. After adding polyvinyl alcohol (binder) in an amount of 1.0 weight %, the pulverized powder was granulated by spray-drying. After being sintered in an aluminum vessel and heat-treated in conditions shown below, the granulates were disintegrated and classified to obtain each ferrite carrier having an average particle size shown in Table 1.

(A) $Li_2O$ (6)+MnO (30)+$Fe_2O_3$ (64) (% by mole)

Sintering: At 1280° C. in air for 5 hours.

Heat treatment: At 950° C. in $N_2$ ($O_2$ concentration: about zero %) for 2 hours.

(B) $Li_2O$ (9)+MnO (18)+$Fe_2O_3$ (73) (% by mole)

Sintering: At 1320° C. in air for 5 hours.

Heat treatment: No.

(C) $Li_2O$ (12)+MnO (8)+$Fe_2O_3$ (80) (% by mole)

Sintering: At 1280° C. in air for 5 hours.

Heat treatment: At 950° C. in $N_2$ ($O_2$ concentration: about zero %) for 2 hours.

(D) $Li_2O$ (9)+MnO (18)+$Fe_2O_3$ (73) (% by mole)

Sintering: At 1150° C. in air for 5 hours.

Heat treatment: No.

(E) $Li_2O$ (12)+MnO (8)+$Fe_2O_3$ (80) (% by mole)

Sintering: At 1280° C. in air for 5 hours.

Heat treatment: No.

The carriers C and E were coated with 2.0 parts by weight of a silicone resin (SR2410 manufactured by Toray Silicone Co. Ltd.) based on 100 parts by weight of each carrier by a fluidized bed method at 200° C. for 2 hours.

Production of Toner

The toner was produced as follows. The following starting materials (part by weight):

binder resin: bisphenol A-type polyester (Mw=19600, Mn=2000) 87 parts, colorant: carbon black (#50, manufactured by Mitsubishi Chemicals Corporation) 10 parts, releasing agent: polypropylene (TP32, manufactured by Sanyo Chemical Industries, Ltd.) 2 parts, and charge control agent: (Kayacharge T-2N, manufactured by Nippon Kayaku Co., Ltd.) 1 part were dry blended. The mixture was melt-kneaded in a twin-screw kneader at 150° C., cooled and coarsely pulverized by a mechanical pulverizer until the pulverized powder passed through 1 mm mesh. The powder was then finely pulverized by an air pulverizer and jet mill, followed by the classification by an air classifier (100MZR manufactured by Arpine Co.) to obtain a powder having a volume average particle size about 10 $\mu$m. The 100 parts by weight of the powder thus obtained was added with 0.5 part by weight of a hydrophobic silica (flowability improver, Aerosil R972 manufactured by Nippon Aerosil Co.) to obtain a negatively chargeable toner. The triboelectric charge and the specific volume resistivity of the toner were −27.8 $\mu$C/g and $10^{14}$ Ω•cm, respectively.

In the present invention, the properties of the carrier and the toner were measured as follows.

The specific volume resistance of the carrier and toner was determined as follows. An appropriate amount of the toner or carrier was charged into a Teflon (trade name) cylinder having an inner diameter of 3.05 mm in a height of about 2 mm. The sample was exposed to an electric field of D.C. 200 V/cm (carrier) or D.C. 4 kV/cm (toner) under a load of 200 gf to measure an electric resistance using an insulation-resistance tester (4329A manufactured by Yokogawa-Hewlett-Packard, Ltd.).

The triboelectric charge of the toner was determined as follows. A magnetic developer having a toner content of 5 weight % was agitated well, and blown at a blowing pressure of 1.0 kgf/cm$^2$. The triboelectric charge of the toner thus treated was measured by using a triboelectric charge measuring apparatus (TB-200 manufactured by Toshiba Chemical Co. Ltd.).

The volume-average particle size of the carrier was calculated from a particle size distribution obtained by a multi-sieve shaking machine. The volume-average particle size of the toner was measured by a particle size analyzer (Coulter Counter Model TA-II manufactured by Coulter Electronics Co.).

The magnetization at a magnetic field of 1000 Oe ($\sigma_{1000}$) of the carrier were measured by using a vibrating magnetometer (VSM-3 manufactured by Toei Kogyo K. K.).

A two-component magnetic developer having a toner concentration of 5 weight % was prepared by mixing the above toner with each ferrite carrier. By using the two-component developer, the image forming tests were conducted under the following conditions.

Photosensitive drum: organic photoconductor
surface potential −650 V
peripheral speed: 60 mm/s
Developing roll:
magnet roll: stationary
non-symmetric 4-poles
surface magnetic flux density
developing pole 800 G
other poles 700 G
sleeve: SUS304
20 mm outer diameter
rotation speed: 150 rpm
Developing gap: 0.5 mm
Doctor gap: 0.4 mm
Bias voltage: −550 V (D.C.)
Transfer: corona transfer
Fixing: heat roll (180° C., 1 kgf/cm line pressure) on ordinary paper
Atmosphere: 20° C., 60% R.H.

The images reproduced in the initial stage of the developing operation and after the continuous developing operations of 10000 times were observed with respect to the image reproducing properties. The results are shown in Table 1.

TABLE 1

| No. | Carrier | Specific volume resistance (Ω · cm) | Average particle size ($\mu$m) | Surface roughness | Average grain size ($\mu$m) | Bulk density (g/cm$^3$) | $\sigma_{1000}$ (emu/g) | Heat treatment |
|---|---|---|---|---|---|---|---|---|
| | | | | Examples | | | | |
| 1 | A | $1 \times 10^7$ | 50 | Yes | | 2.3 | 55 | Yes |
| 2 | B | $5 \times 10^8$ | 75 | Yes | | 2.4 | 53 | No |
| 3 | C*1 | $2 \times 10^{13}$ | 40 | Yes | | 2.0 | 51 | Yes |
| | | | | Comparative Examples | | | | |
| 1 | D | $1 \times 10^9$ | 50 | Yes*2 | | 2.0 | 42 | No |
| 2 | E*1 | $5 \times 10^{14}$ | 40 | No | | 1.9 | 53 | No |

| | Initial Stage | | | After 100000 development | | |
|---|---|---|---|---|---|---|
| No. | Image density | Background fogging | Carrier adhesion | Image density | background fogging | Carrier adhesion |
| | | | Examples | | | |
| 1 | 1.41 | 0.04 | good | 1.39 | 0.03 | good |
| 2 | 1.39 | 0.03 | good | 1.40 | 0.04 | good |
| 3 | 1.35 | 0.03 | good | 1.35 | 0.03 | good |
| | | | Comparative Examples | | | |
| 1 | 1.26 | 0.11 | poor | 1.25 | 0.13 | poor |
| 2 | 1.38 | 0.05 | good | 1.28 | 0.12 | good |

Note:
*1Resin coating.
*2Surface roughness due to geometric shape or primary particles.

In Table 1, the image density is a reflectance optical density measured by a Macbeth densitometer, and the background fogging is a difference in density of non-printed area of paper between before and after printing, and was measured by a calorimetric color-difference meter manufactured by Nippon Denshoku Kogyo K. K. The background fogging of 0.08 or less causes no problem for practical use, and excellent when 0.05 or less. The carrier adhesion was evaluated by observing the presence of white spots in the image areas, and evaluated as "good" when practically no white spot was noticed, and "poor" when the white spots were found in an appreciable amount.

In Comparative Example 1, since the carrier D had a low $\sigma_{1000}$, there was a marked occurrence of the carrier adhesion. In addition, the relatively large surface roughness due to the geometric shape of primary particles lowered the flowability of the carrier to result in an insufficient charge of the toner, this causing the background fogging. Nearly the same results were obtained after 100000 continuous reproducing operations on A4-size papers. In Comparative Example 2, since the carrier E was produced without the heat treatment after the sintering step, the surface of the carrier E had no surface roughness defined in the present invention. As a result thereof, after 100000 continuous reproducing operations, the resin coating exfoliated from the carrier and the spent toner was produced. Also, the background fogging was increased due to the spent toner.

In Examples 1 to 3, the carriers A to C had a minute roughness on the surface of crystal grains formed by the heat treatment or the fusion of the small particles to the large particles. The results showed that the minute roughness on the surface of crystal grains enhanced the ability of the carrier to triboelectrically charge the toner, thereby providing images of a good quality even when the carrier was not coated with a resin coating (Examples 1 and 2). In addition, the results showed that the bonding strength of the resin coating was enhanced by the anchor effect of the minute roughness on the grain surface to cause no significant exfoliation of the resin coating from the carrier even after 100000 continuous reproducing operations, thereby providing images of a good quality.

FIG. 1 shows a schematic representation of the carrier of the present invention illustrated on the basis of an electron photomicrograph. The ferrite carrier of the present invention is composed of an aggregation of the crystal grains 1, the surface of which has a wrinkle-like minute roughness. The reference numeral 2 shows grain boundaries of the grains 1. The wrinkle-like minute roughness on the grain surface is advantageous in enhancing the ability of the carrier to triboelectrically charge the toner as compared with the roughness based on the geometric shape of the primary particles. Also, the minute roughness on the grain surface enhances the bonding strength of the resin coating to the carrier surface to prolong the life of the carrier.

What is claimed is:

1. A ferrite carrier for use in electrophotographic development comprising ferrite particles having a chemical composition of 3 to 15% of $Li_2O$, 5 to 35% of MnO and 60 to 90% of $Fe_2O_3$, each in terms of percent by mole, said ferrite particles consisting essentially of crystal grains having an average grain size of 1 to 50 $\mu$m, and said crystal grains having a minute roughness on a surface thereof.

2. The ferrite carrier according to claim 1, wherein a part of at least one of said $Li_2O$, MnO and $Fe_2O_3$ is substituted by at least one oxide selected from the group consisting of NiO, MgO, ZnO, CuO, BaO and SrO.

3. The ferrite carrier according to claim 1, wherein said ferrit e carrier is coated with a resin coating.

4. The ferrite carrier according to claim 3, wherein said resin coating is a silicone resin coating.

5. The ferrite carrier according to claim 1, wherein a volume average particle size of said ferrite carrier is 10 to 150 $\mu$m.

6. The ferrite carrier according to claim 1, wherein a specific volume resistance of said ferrite carrier is $10^4$ to $10^{14}$ Ω•cm when measured in an electric field of D.C. 200 V/cm.

7. A ferrite carrier for use in electrophotographic development comprising ferrite particles having a chemical composition of 3 to 15% of $Li_2O$, 5 to 35% of MnO and 60 to 90% of $Fe_2O_3$, each in terms of percent by mole, said ferrite particles consisting essentially of crystal grains having an average grain size of 1 to 50 $\mu$m, and said crystal grains having a minute roughness on a surface thereof, wherein said ferrite carrier has a magnetization between 45 to 80 emu/g measured in a magnetic field of 1000 Oe and a specific volume resistivity between $10^4$ to $10^{14}$ Ωcm when measured in an electric field of D.C. 200 V/cm.

8. The ferrite carrier according to claim 7, wherein a part of at least one of said $Li_2O$, MnO and $Fe_2O_3$ is substituted by at least one oxide selected from the group consisting of NiO, MgO, ZnO, CuO, BaO, and SrO.

9. The ferrite carrier according to claim 7, wherein said ferrite carrier is coated with a resin coating.

10. The ferrite carrier according to claim 9, wherein said resin coating is a silicone resin coating.

11. The ferrite carrier according to claim 7, wherein a volume average particle size of said ferrite carrier is 10 to 150 $\mu$m.

* * * * *